US005921096A

United States Patent [19]

Warren

[11] Patent Number: 5,921,096

[45] Date of Patent: Jul. 13, 1999

[54] MODULAR TEMPERATURE MAINTAINING FOOD RECEPTACLE SYSTEM

[76] Inventor: John S. Warren, 35871 N. Helendale, Ingleside, Ill. 60041

[21] Appl. No.: 08/947,757

[22] Filed: Oct. 9, 1997

[51] Int. Cl.[6] ..... F25D 17/02

[52] U.S. Cl. ..... 62/185; 62/258; 62/434

[58] Field of Search ..... 62/258, 434, 435, 62/185

[56] References Cited

U.S. PATENT DOCUMENTS

| | | | |
|---|---|---|---|
| 3,127,928 | 4/1964 | Ringquist | 62/435 |
| 3,216,215 | 11/1965 | Schuett | 62/435 |
| 3,888,303 | 6/1975 | Skala | 165/2 |
| 4,026,351 | 5/1977 | Biava | 165/58 |
| 4,182,405 | 1/1980 | Hysen et al. | 165/48 |
| 4,275,568 | 6/1981 | Zielsdorf | 62/342 |
| 4,362,028 | 12/1982 | Armstrong | 62/390 |
| 4,593,752 | 6/1986 | Tipton | 165/48.1 |
| 4,856,579 | 8/1989 | Wolfe | 165/48.1 |
| 4,870,835 | 10/1989 | Wolfe et al. | 62/246 |
| 4,949,552 | 8/1990 | Adams | 62/196.4 |
| 5,148,861 | 9/1992 | Colvin et al. | 165/78 |
| 5,159,973 | 11/1992 | Pennington et al. | 165/48.1 |
| 5,201,194 | 4/1993 | Flynn, Jr. et al. | 62/457.2 |
| 5,201,364 | 4/1993 | Tippmann et al. | 165/26 |
| 5,247,807 | 9/1993 | Jarman et al. | 62/227 |
| 5,285,051 | 2/1994 | DeGrow et al. | 219/386 |
| 5,297,616 | 3/1994 | Pralus | 165/47 |
| 5,355,687 | 10/1994 | Carpenter et al. | 62/258 |
| 5,381,670 | 1/1995 | Tippmann et al. | 62/434 |

OTHER PUBLICATIONS

Perfection Model Beermizer™, Perfection Equipment, Inc., 2 pp. advertizement [no date].

Perfection Model Mini–1 Glycol Circulator—Specifications, Perfection Equipment, Inc., 1 p. [no date].

Perfection Equipment, Inc., Product Catalog, 6 pp. [no date].

International Kitchenwares Inc., Chilla™ advertisement, 2 pp [no date].

Colder Products Company, Quick Couplings and Fittings for Plastic Tubing, pp. 1–48 [no date].

*Primary Examiner*—William E. Tapolcai

*Attorney, Agent, or Firm*—Welsh & Katz, Ltd.

[57] ABSTRACT

A modular refrigerated food container system for use in buffet bars in restaurants and the like includes a plurality of food storage receptacles for receiving food and a plurality of receptacle temperature maintaining modules where each temperature maintaining module is configured to receive the food storage receptacle and is configured to thermally communicate with the food storage receptacle to maintain a predetermined temperature of the food storage receptacle. Each temperature maintaining module is fluidly connected to adjacent temperature maintaining modules and a refrigeration device operatively coupled to the plurality of temperature maintaining modules provides thermal exchange fluid to each temperature maintaining module. Each temperature maintaining module further includes a thermally conducting inside wall, a substantially insulating outside wall, and a heat exchange device disposed therebetween. A thermostat regulates the temperature of each temperature maintaining module independent of the temperature of adjacent temperature maintaining modules.

25 Claims, 3 Drawing Sheets

MODULAR TEMPERATURE MAINTAINING FOOD RECEPTACLE SYSTEM

BACKGROUND OF THE INVENTION

The present invention relates generally to a system for maintaining food items at required temperatures and more specifically to a modularized system for temperature maintaining food receptacles in a food service establishment.

As is well known to those familiar with restaurant establishments and the like, self-service buffet bars are extremely popular. Generally, self-service buffet bars are of two basic types. The first type is a free-standing buffet bar that includes a cabinet having a counter top provided with one or more openings. The openings are fitted with one or more relatively shallow pans used to hold crushed ice. Food or condiment containers of assorted sizes are then placed in the ice so that the foodstuffs in the containers are maintained at a relatively low temperature to preserve the contents against premature spoilage.

This known type of buffet bar has been in use for many years and suffers from a number of shortcomings. Such buffet bars require a very high level of maintenance since the ice must be frequently replenished as it melts. Often, the ice is not timely replaced and the foodstuffs are subjected to unacceptably high temperatures. This may result in food spoilage and may have serious health related consequences for those who consume food exposed to such elevated temperatures. Additionally, health code violations may result which have adverse consequences, such as fines, closure of the establishment, damaging publicity and loss of patronage.

A second type of known buffet bar incorporates a fixed refrigeration unit within the buffet bar cabinet having an extended cooling coil positioned against the bottom of a cold pan or plate located beneath the food containers. Unfortunately, the cooling coil presents difficulties in maintaining a suitable controlled heat transfer relationship between the containers and the refrigerated plate or recessed pan and may result in the foodstuffs either freezing or becoming too warm. Such refrigeration units are expensive to purchase and to maintain.

Additionally, temperature control of individual food containers cannot be easily accomplished since only a central refrigeration unit is provided. Individual temperature control is desirable in more sophisticated food service establishments where haute-cuisine cooking may required individualized temperature of various food components.

Typically, the entire buffet bar must be removed from service for an extended period of time to effect repair of the refrigeration unit. This is a significant disadvantage of both types of buffet bars and is inherent to fixed refrigeration systems which may become a significant liability when repair is required. Even more significantly, federal environment protection regulations may require the purchase of expensive equipment to service and repair the refrigeration unit on site. Thus, the manager of a food service establishment utilizing such buffet bars may be subject to significant inconvenience and cost when the refrigeration unit requires servicing and repair.

Known buffet bars typically use a refrigeration/heating system that relies solely on Freon or other chlorofluorocarbons (CFC) considered detrimental to the environment and now subject to strict regulation and phase-out provisions.

Typical CFC replacement refrigeration/heating devices are expensive to purchase and maintain.

Prior art attempts to improve buffet bars in food service establishments have failed to provide a buffet bar with an efficient system having modular replaceable refrigerated food containers.

Accordingly, it is an object of the present invention to overcome the above problems.

It is another object of the present invention to provide a modular temperature maintaining food container system where individual temperature maintaining modules can be physically positioned independently of each other and without need of a single tabletop.

It is a further object of the present invention to provide a modular temperature maintaining food container system where the temperature of individual food containers can be independently controlled.

It is yet another object of the present invention to provide a modular temperature maintaining food container system where each temperature maintaining module may be rapidly and easily disconnected from and added to the system.

It is an additional object of the present invention to provide a modular temperature maintaining food container system that can be easily moved from one location to another.

It is an additional object of the present invention to provide a modular temperature maintaining food container system where the heat exchange device uses minimal chloro-fluorocarbon technology.

It is still an additional object of the present invention to provide a modular temperature maintaining food container system where each module contains a thermostatically controlled heat exchange device.

It is another object of the present invention to provide a modular food container system that can easily be modified to cool or heat food receiving modules.

SUMMARY OF THE INVENTION

The disadvantages of known buffet bar food containing systems are substantially overcome with the present invention by providing a novel modular temperature maintaining food container system where individual food temperature maintaining modules are provided having a thermostat to regulate the temperature of food storage receptacles placed in the temperature maintaining module. The temperature maintaining modules are connected in series by flexible tubing to a glycol based refrigeration device. The entire system is designed in order to provide for set up and disassembly of the system to facilitate quick and efficient movement from one location to another.

Chilled liquid glycol transported through flexible tubing circulates through a heat exchange device in each temperature maintaining module to cool the inside wall of the temperature maintaining module. The cooled inside wall is in contact with a thermally conducting wall of the food storage receptacle to cool the food contained therein.

More specifically, a modular refrigerated food container system for use in buffet bars in restaurants and the like includes a plurality of food storage receptacles for receiving food and a plurality of receptacle temperature maintaining modules where each temperature maintaining module is configured to receive the storage receptacle and is configured to thermally communicate with the food storage receptacle to maintain a predetermined temperature of the food storage receptacle. Each temperature maintaining module is fluidly connected to adjacent temperature maintaining modules in a series configuration and a refrigeration device, e.g., a heat pump, operatively coupled to the plurality of temperature maintaining modules provides thermal exchange fluid to each temperature maintaining module. Each temperature maintaining module further includes a thermally conducting inside wall, a substantially insulating outside wall, and a heat exchange device disposed therebetween. A thermostat regulates the temperature of each temperature maintaining module independent of the temperature of adjacent temperature maintaining modules.

BRIEF DESCRIPTION OF THE DRAWINGS

The features of the present invention which are believed to be novel are set forth with particularity in the appended claims. The invention, together with further objects and advantages thereof, may best be understood by reference to the following description in conjunction with the accompanying drawings.

DETAILED DESCRIPTION OF THE INVENTION

Figure 1:
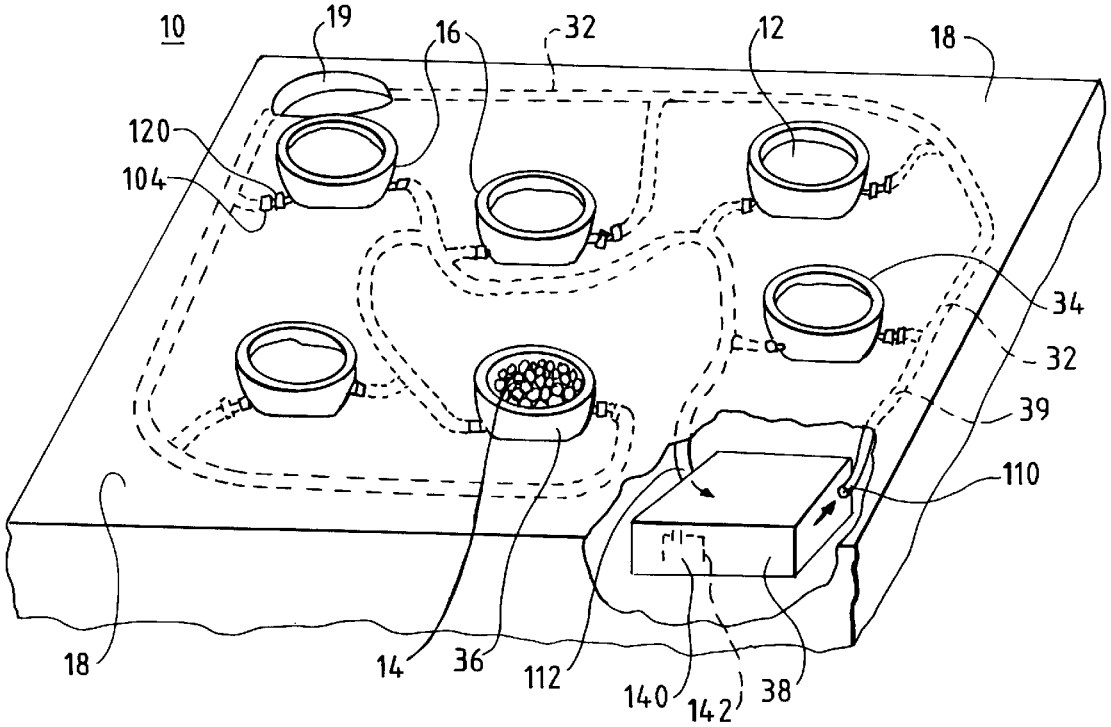
FIG. 1 is a perspective view of a specific embodiment of a modular food container system according to the present invention.

Referring now to FIG. 1, a specific embodiment of a modular temperature maintaining food receptacle system 10 is shown generally. The system 10 includes a plurality of food storage receptacles 12 for receiving foodstuffs 14 and a plurality of receptacle temperature maintaining modules 16 for receiving the food storage receptacles. The food storage receptacles 12 and the receptacle temperature maintaining modules 16 may be placed on a platform 18, such as an elevated bar or a standard buffet bar cart, as is well known in the art.

Alternatively, the food storage receptacles 12 and associated receptacle temperature maintaining modules 16 may be placed in different locations separated by a fixed distance to increase its aesthetic appeal, such as in a "theme" setting. For example, the food storage receptacles 12 and associated temperature maintaining modules 16 may be placed at different elevations and distances along a decorative display where various culinary delights are provided. A suitably shaped cover 19 may be provided to fit over the temperature maintaining module 16 for aesthetic and sanitary considerations. The cover 19 may also aid in temperature regulation.

Each temperature maintaining module 16 is fluidly connected to adjacent temperature maintaining modules 16 in a series configuration by sections of substantially flexible fluid transporting tubes 32. The fluid transporting tube 32 may, for example, be vinyl tubing Model Superflex tubing manufactured by Foxx Corporation.

A first temperature maintaining module 34 and a last temperature maintaining module 36 are operatively coupled to a refrigeration device 38, e.g., a heat pump, which provides thermal exchange fluid 39, such as liquid glycol or other suitable cooling medium, to each temperature maintaining module 16 through the fluid transporting tubes 32. The refrigeration device 38 may be a Model RA-34, BBB VH-1, or Mini-1 glycol circulating pump manufactured by Perfection Equipment Corporation of Gurnee, Ill. Alternatively, the system 10 may be provided with only a single temperature maintaining module 16 which is coupled to the refrigeration device 38.

The fluid transporting tubes 32 may be substantially flexible such that the temperature maintaining modules 16 can be positioned at various elevations and at various positions within a "theme" setting. For example, in a nature based theme setting, the temperature maintaining modules 16 may be positioned in simulated tree outcroppings, cave ledges or other outdoor environments and may be connected to adjacent cooling modules by a relatively long length of flexible fluid transporting tube 32. The fluid transporting tubes 32 may be hidden for aesthetic appeal. Alternatively, the fluid transporting tubes 32 may be rigid.

Figure 2:
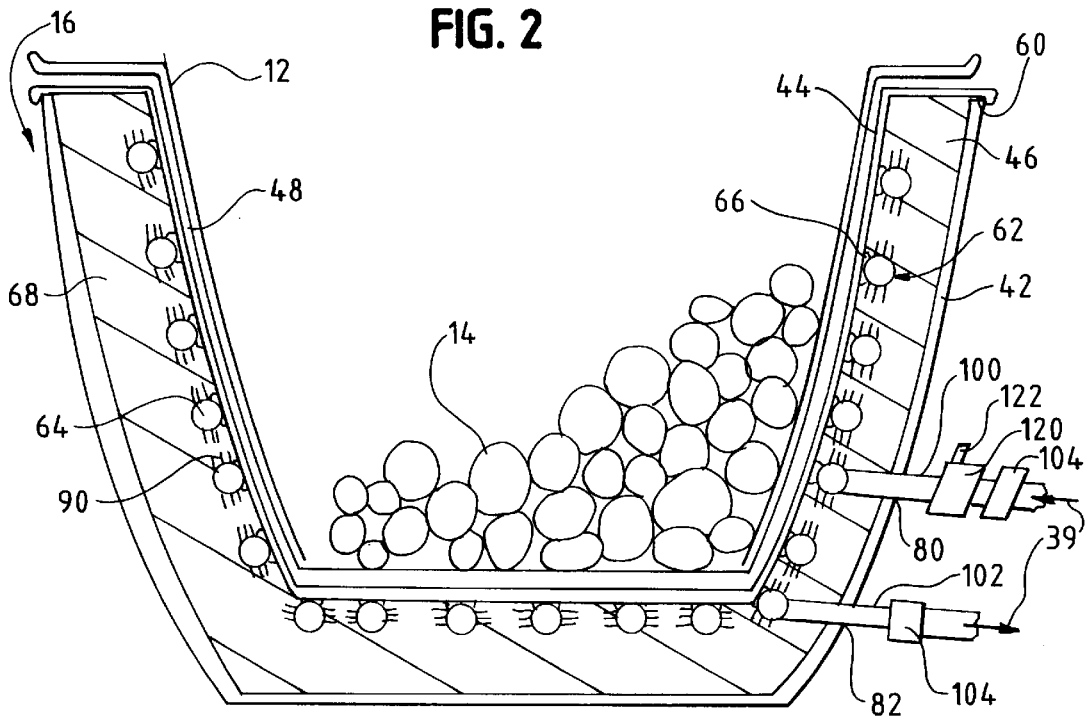
FIG. 2 is a side sectional view of a specific embodiment of a temperature maintaining module and a food storage receptacle according to the present invention.

Referring now to FIGS. 1 and 2, the temperature maintaining module 16 includes a substantially insulating outside wall 42 which may, for example, be constructed from wood, plastic, ceramic and the like. A thermally conducting inside wall 44 housed within the outside wall 42 forms a hollow space 46 therebetween. The thermally conducting inside wall 44 may, for example, be constructed from stainless steel, aluminum, copper or any other suitable metal or conducting material.

The food storage receptacle 12 has a contour similar to the contour of the inside wall 44 and is similarly constructed from stainless steel, aluminum, copper or any other suitable metal or conducting material. The food storage receptacle 12 may be placed in the temperature maintaining module 16 so that its thermally conducting walls are in close contact with the inside wall 44 of the temperature maintaining module 16. When the inside wall 44 of the temperature maintaining module 16 is reduced in temperature, as will be described hereinafter, heat exchange between the two walls occurs, and the food storage receptacle 12 and the foodstuffs 14 contained therein are also reduced in temperature. For purposes of illustration only, a gap 48 can be seen between the inside wall 44 and the food storage receptacle 12. In operation, a gap 48 is not required and the two surfaces 44 and 12 are in contact to facilitate heat transfer. However, if a gap 48 is present, a fluid such as water or other thermally conducting medium may be placed in the gap to further facilitate heat transfer.

The thermally conducting inside wall 44 and the insulating outside wall 42 are sealed about a peripheral edge 60 to provide a fully closed and sanitary temperature maintaining module 16. Such a sanitary seal may be effected through use of a crimp seal, a suitable chemical adhesive, ultrasonic welding, or any other suitable method, as is well known in the art. It is important that the seal is permanent and watertight so that contaminants are not able to enter the temperature maintaining module 16 and no area exists where bacterial growth can occur. The temperature maintaining module 16 complies with applicable health code regulations and further meets NSF (National Sanitation Foundation) standards.

The temperature maintaining modules 16 may be cooled or heated depending on the user's requirements. To cool the inside wall 44, a heat exchange device 62 is disposed between the inside wall and the insulating outside wall 42.

The heat exchange device 62 may include a heat exchange tube 64 that is wound in a spiral configuration around the inside wall 44 to evenly distribute cooling to the inside wall 44. However, the pattern of the heat exchange tube 64 is not limited to a spiral configuration and any pattern may be used which adequately promotes heat exchange between the heat exchange device 62 and the thermally conducting inside wall 44. For example, the heat exchange tube 64 may appear as a "sine wave" pattern circumscribing the inside wall 44.

The heat exchange tube 64 may, for example, be constructed from ⅜ inch outside diameter copper tubing affixed to the inside wall by clips, welds, brackets 66 and the like. Insulating material 68, such as foam or fiberglass, may fill the hollow space 46 between the inside wall 44 and the outside wall 42 to further facilitate directing heat exchange between the heat exchange device 62 and the thermally conducting inside wall 44. Alternatively, the insulating material 68 may hold the heat exchange device 62 in place against the inside wall 44. The insulation 68 also prevents a substantial change in temperature of the insulating outside wall 42.

The heat exchange tube 64 enters the cooling module 16 through an input port 80 and follows a generally spiral path around the inside wall 44. The heat exchange tube 64 may "double back" and exit through an output port 82 disposed adjacent or opposite the input port 80 to provide a convenient and partially hidden access point to the temperature maintaining module 16. It may be aesthetically desirable to hide the input 80 and output ports 82 and the flexible fluid transporting tubes 32 connecting adjacent temperature maintaining modules 16 when the temperature maintaining modules 16 and food 14 are displayed in the restaurant setting.

Figure 3:
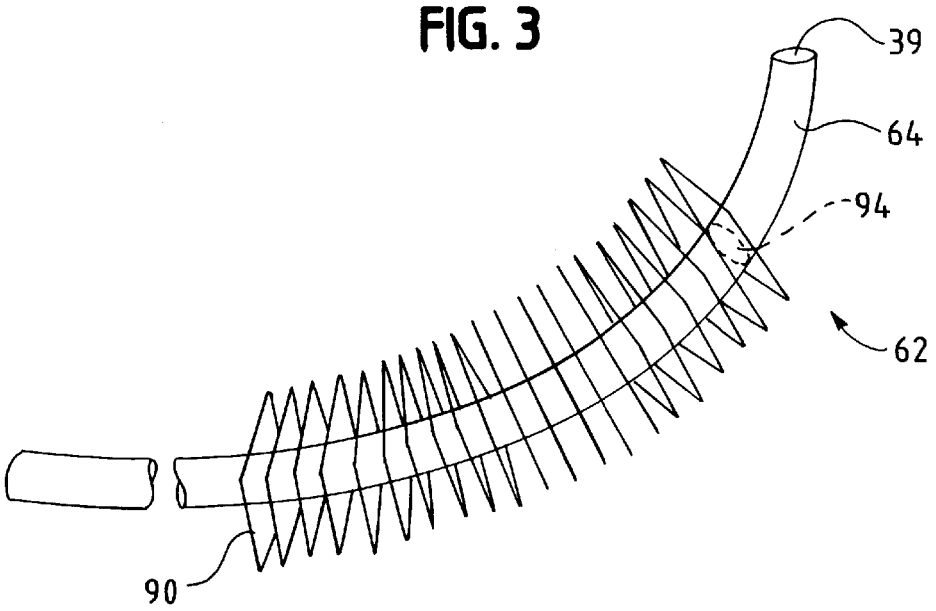
FIG. 3 is a perspective view of a heat exchange device shown in FIG. 2.

Referring now to FIGS. 2 and 3, the heat exchange tube 64 may have a plurality of heat sink fins 90 attached thereto to increase the rate of heat exchange between the thermal exchange fluid 39 flowing through the heat exchange tube 64, and the thermally conducting inside wall 44 against which the heat exchange device 62 is proximally disposed. The heat sink fins 90 may be constructed from aluminum, copper or other suitable heat conducting material and may have a central aperture 94 through which the heat exchange tube 64 passes. The heat sink fins 90 may be spaced close enough to allow a large number of fins to be distributed along the heat exchange tube 64. The spacing therebetween must also be large enough to facilitate optimal heat dissipation, as is well known in the art. The heat sink fins 90 may be circular or rectangular in shape and are generally parallel to adjacent fins 90. Alternatively, the heat sink fins 90 may be parallel to a portion of the heat exchange tube and may be distributed along its length.

The heat exchange device 62 is essentially a coil-type radiator similar to automobile and refrigerator radiators and may be similarly constructed, as is well known in the art. The heat sink fins 90 facilitate heat exchange between the cooled thermal exchange fluid 39 flowing within the heat exchange tube 64 and the inside wall 44, by providing a larger effective surface area for thermal transfer. Thus, the heat exchange device 62 cools the thermally conducting inside wall 44 of the temperature maintaining module 16 and hence, the food storage receptacle 12 and perishable food 14 contained therein.

Referring now to FIGS. 1 and 2, the input port 80 is formed from a first end 100 of the heat exchange tube 64 while the output port 82 is formed from a second first end 102 of the heat exchange tube. Both the input port 80 and the output port 82 include a releasable coupling 104 to which the fluid transporting tubes 32 are connected to fluidly couple adjacent temperature maintaining modules 16. The couplings 104 may, for example, be thermoplastic quick couplings Model PMC series manufactured by Colder Products Company of St. Paul, Minn. Such quick couplings 104 allow the fluid transporting tubes 32 to be disconnected while retaining the thermal exchange fluid 39 within the heat exchange tube 64 and within the fluid transporting tubes 32.

Thus, when the fluid transporting tubes 32 are disconnected from the temperature maintaining modules 16, no fluid escapes or seeps out of the module 16 or the tubes 32. All fluid internal to the temperature maintaining module 16 remains trapped within the heat exchange tube 64 since the input port 80 and output port 82 are automatically sealed by the couplings 104.

This feature is significant and allows for easy and rapid cleaning and/or repositioning of the system 10. If the temperature maintaining module 16 becomes soiled, the fluid transporting tubes 32 are simply disconnected and the module 16 is cleaned, for example, by placing it in a dishwasher. The couplings 104 prevent fluid escape even under dishwashing conditions.

The refrigeration device 38 is coupled to each of the temperature maintaining modules 16 in a series or parallel configuration. Such a connection allows for quick and inexpensive addition and removal of temperature maintaining modules 16 to suit individual applications. For both a series and a parallel connection, a chiller output 110 from the refrigeration device 38 provides the cooled thermal exchange fluid 39 to the input port 80 of the first temperature maintaining module 34. A parallel connection is shown in FIG. 1. The input port 80 of the first temperature maintaining module 34 is connected to the input port 80 of the adjacent temperature maintaining module 16. The output port 82 of the first temperature maintaining module 34 is connected to the output port 82 of the adjacent temperature maintaining module 16. In a series connection, the output port 82 of the first temperature maintaining module 34 is, in turn, coupled to the input port 80 of the adjacent temperature maintaining module 16. For both series and parallel connection, the output port 82 of the last temperature maintaining module 16 is then connected to a chiller input 112 of the refrigeration device 38 to complete the return path to the refrigeration device. Each temperature maintaining module 16 is connected to adjacent temperature maintaining modules 16 by the fluid transporting tubes 32 forming a closed loop between the temperature maintaining modules 16 and the refrigeration device 38.

The refrigeration device 38 may be a Model RA-34, BBB VH-1, or Mini-1 glycol circulating pump manufactured by Perfection Equipment Corporation of Gurnee, Ill. Glycol circulating pumps are energy-efficient and cost-effective and eliminate many of the problems associated with CFC based refrigeration systems. The refrigeration device 38 may be conveniently housed under the platform 18 or may be centrally located. For example, a central roof-top or room based glycol pump refrigeration device 38 may provide cooled thermal exchange fluid (glycol) 39 to many individual temperature maintaining modules 16 distributed throughout the food service establishment.

Each temperature maintaining module 16 may be equipped with its own thermostat 120 which may be coupled between the input port 80 and the coupling 104. The thermostat 120 monitors the temperature of the liquid glycol 39 entering the temperature maintaining module 16 and adjusts the temperature accordingly. A control knob 122 may be provided for user control. Individual thermostatic regulation is feasible since the temperature of the glycol thermal exchange fluid 39 may be regulated by the introduction of air into the fluid. The thermostat 120 simply injects a predetermined amount of air into the glycol thermal exchange fluid 39 until the desired temperature is attained, at which time, the thermostat 120 ceases further air injection. Since each temperature maintaining module 16 is individually controlled, the complexity and cost of the refrigeration device 38 may be reduced.

Alternatively, the entire system 10 may be converted to heat the modules 16 by suitable substitution of the refrigeration device 38. A similar glycol pump 140 manufactured by HATCO Company of Milwaukee may be substituted for the glycol pump 38 manufactured by Perfection Equipment Corporation of Gurnee, Ill., as described above. The heating glycol pump 140 may include an internal heating coil 142 which heats the glycol supplied to each temperature maintaining module 16, as is well known in the art.

The system 10, when used to heat the modules 16, functions in a similar manner as when used to cool the modules 16. The heated thermal exchange fluid 39 (glycol) is circulated through each temperature maintaining module 16 and heat carried by the fluid is transferred from the heat exchange tube 64 to the inside wall 44 and to the food storage receptacle 12. Thus, by appropriate selection of a commercially available glycol pump (38 or 140), the entire system 10 can be used either to heat all of the modules 16 or cool all of the modules 16, depending upon the type of foodstuffs 14 contained in the food storage receptacles 12. It may be appreciated that any reference to and description of cooling of the modules 16 may equally apply to heating of the modules 16.

Figure 4:
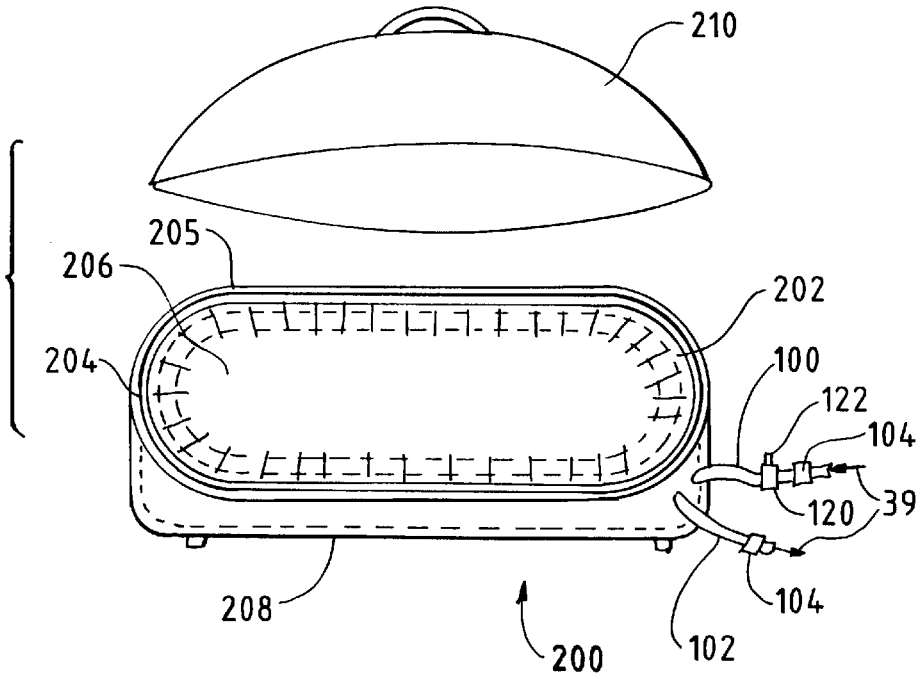
FIG. 4 is a perspective view of an alternate embodiment of a temperature maintaining module according to the present invention.

Referring now to FIGS. 1 and 4, FIG. 4 illustrates an alternate embodiment. The temperature maintaining module 16 (FIG. 1) need not be bowl-like in shape and may, for example, be a flat tray 200 (FIG. 4). In such a flat embodiment, the temperature maintaining module 200 is essentially configured as a serving tray having the heat exchange device 62 coupled to an interior surface 205 of a thermally conducting top portion 204. A food storage receptacle 206 has a contour similar to the contour of the inside surface of the thermally conducting top portion 204 and is similarly constructed from stainless steel, aluminum, copper, or any other suitable metal or conducting material. The food storage receptacle 206 may be placed in the temperature maintaining module 200 so that its thermally conducting walls are in close contact with the interior surface 205 of the thermally conducting top portion 204. The top portion 204 may be affixed and sealed to an insulating bottom portion 208 to form a sealed and sanitary temperature maintaining module 200. A suitably shaped cover 210 may be placed over the temperature maintaining module 200 for aesthetic and sanitary purposes. Additionally, multiple flat temperature maintaining modules 200 may be connected in series or parallel with other flat temperature maintaining modules 200 or with bowl-shaped temperature maintaining modules 16 (FIG. 1) to provide a wide variety of configurations.

Referring now to FIGS. 1–3. in operation, the temperature maintaining modules 16 are connected to each other either in parallel or series and are eventually connected to the refrigeration device 38 (or heating device 140) through the fluid transporting tubes 32. The temperature maintaining modules 16 may be placed on a central platform 18 or may be distributed about the restaurant in various locations.

The refrigeration device 38 (or heating device 140) is activated and chilled (or heated) thermal exchange fluid 39, such as liquid glycol, is circulated through the arrangement of temperature maintaining modules 16. As the cooled (heated) glycol enters the heat exchange device 62 within each temperature maintaining module 16, the inside wall 44 of the temperature maintaining module 16 is cooled (heated). Since the thermally conducting food storage receptacle 12 is in thermal communication with the inside wall 44 of the temperature maintaining module 16, it is also cooled (heated), thus maintaining the temperature of the foodstuffs contained therein. The thermostat 120 of each temperature maintaining module 16 is set to a predetermined temperature depending upon the type of food contained in each food storage receptacle 12.

Figure 5:
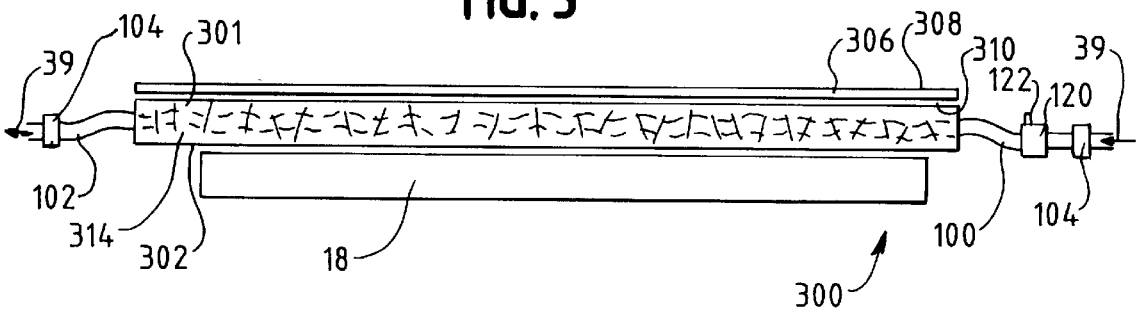
FIG. 5 is a side sectional view of an alternate embodiment of a temperature maintaining module according to the present invention.

Referring now to FIG. 5, FIG. 5 illustrates an alternate embodiment. The temperature maintaining module 16 (FIG. 1) may, for example, be a flat plate holding device 300 (FIG. 5). The flat plate holding device 300 has a thermally conducting top portion 301 and an insulating bottom portion 302. The food storage receptacle 12 (FIG. 1) is a flat thermally conducting plate 306 (FIG. 5). In such a flat embodiment, the temperature maintaining module 300 is configured to receive the flat thermally conducting plate 306. The plate 306 has a substantially flat thermally conducting top portion 308 and a substantially flat thermally conducting bottom portion 310. The plate bottom portion 310 rests on and is in contact with the thermally conducting top portion 301. The plate 306 can be easily removed from the temperature maintaining module 300 and the plate 306 can be constructed of, for example, a mirrored surface, copper, stainless steel or any other any thermally conducting material. Food stuff 14 may be placed directly on the thermally conducting top portion 308 where a heat exchange device 314 cools (or heats) the top portion 308 and the food 14 placed thereon.

Figure 6:
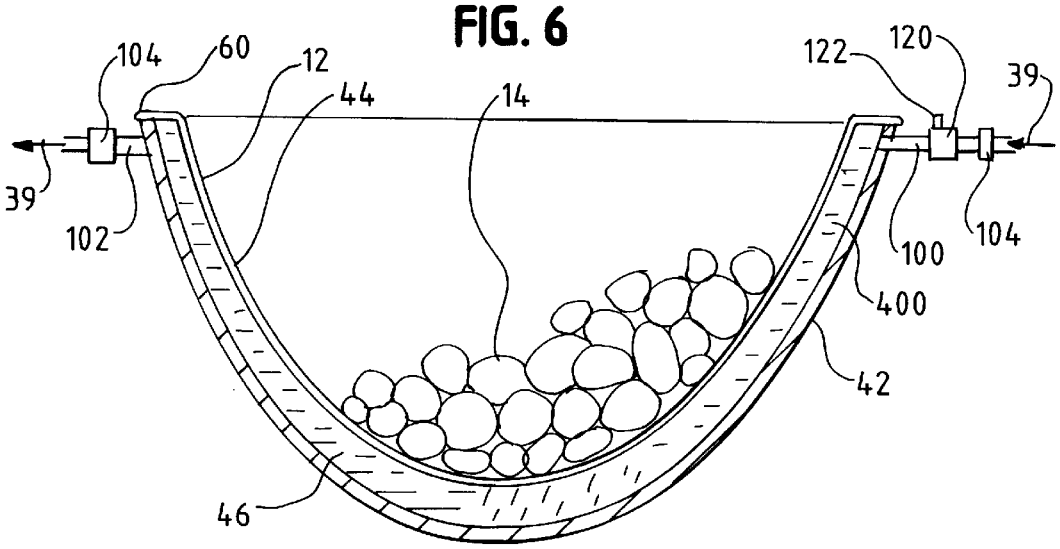
FIG. 6 is a side sectional view of an alternate embodiment of a temperature maintaining module according to the present invention.

Referring now to FIG. 6, FIG. 6 illustrates an alternate embodiment. The heat exchange device 62 may, for example, consist of baffles 400 located in the hollow space 46 and attached to the thermally conducting inside wall 44 and/or the insulating outside wall 42. In operation, the thermal exchange fluid 39 is directed through the hollow space 46 so that it comes into contact with substantially all of the surface area of the thermally conducting inside wall 44. The baffles 400 can be arranged in many different configurations depending on the shape of the receptacle temperature maintaining modules 16. It is intended that the baffles 400 can be used with any of the embodiments previously discussed.

A specific embodiment of a modular refrigerated food container system according to the present invention has been described for the purpose of illustrating the manner in which the invention may be made and used. It should be understood that implementation of other variations and modifications of the invention and its various aspects will be apparent to those skilled in the art, and that the invention is not limited by these specific embodiments described. It is therefore contemplated to cover by the present invention any and all modifications, variations, or equivalents that fall within the true spirit and scope of the basic underlying principles disclosed and claimed herein.

What is claimed is:

1. A modular refrigerated food container system for use in buffet bars, the system comprising:

a plurality of food storage receptacles for receiving food;

a plurality of receptacle temperature maintaining modules, each temperature maiainining module configured to receive the food storage receptacle and thermally communicate therewith to maintain a predetermined temperature of the food storage receptacle;

each said temperature maintaining module fluidly connected to adjacent temperature maintaining modules by a substantially flexible fluid transporting tube; and a refrigeration device operatively coupled to the plurality of temperature maintaining modules to provide thermal exchange fluid to each temperature maintaining module.

2. The system according to claim 1 wherein each temperature maintaining module includes a thermostat to regulate the temperature of the temperature maintaining module independent of the temperature of an adjacent temperature maintaining module.

3. The system according to claim 1 wherein each temperature maintaining module further includes a thermally conducting inside wall, a substantially insulating outside wall, and a heat exchange device disposed therebetween to cool the inside wall.

4. The system according to claim 3 wherein insulating material is disposed between the inside wall and the outside wall to facilitate heat exchange between the thermally conducting inside wall and the heat exchange device.

5. The system according to claim 3 wherein the inside wall and the outside wall are sealed about a peripheral edge to provide a fully closed sanitary temperature maintaining module.

6. The system according to claim 3 wherein the heat exchange device further includes a heat exchange tube configured to transport the thermal exchange fluid, the heat exchange tube having a plurality of heat sink fins attached thereto to increase the rate of heat exchange between the thermal exchange fluid, the heat exchange tube, and the thermally conducting inside wall, said heat exchange device disposed proximate the thermally conducting inside wall.

7. The system according to claim 1 wherein each temperature maintaining module further includes a thermally conducting inside wall, a substantially insulating outside wall, and a space between the inside wall and the outside wall to allow a thermal exchange fluid to pass through to provide heat exchange between the fluid and the inside wall.

8. The system according to claim 7 wherein each temperature maintaining module further includes baffles operatively fixed in the space between the outside wall and the inside wall to guide the thermal exchange fluid through the space so that the fluid comes into contact with the inside wall.

9. The system according to claim 1 wherein each temperature maintaining module includes an input port and an output port.

10. The system according to claim 9 wherein a sealingly releasable fitting coupled to the input port and the output port prevents discharge of the thermal exchange fluid contained in the temperature maintaining module when the fluid transporting tube is disconnected from either the input port or the output port.

11. The system according to claim 2 wherein the refrigeration device is a glycol circulating pump configured to circulate liquid glycol as the thermal exchange fluid.

12. The system according to claim 11 wherein the thermostat regulates the temperature of the temperature maintaining module by introducing a predetermined amount of air into the liquid glycol as the liquid glycol circulates about the temperature maintaining module.

13. The system according to claim 1 wherein the refrigeration device is configured to circulate a liquid thermal exchange fluid.

14. The system according to claim 3 wherein each food storage receptacle is formed from thermally conducting material, said food storage receptacle configured to thermally communicate with the inside wall of the temperature maintaining module such that food received by the food storage receptacle is maintained at substantially the same temperature as that of the inside wall of the temperature maintaining module.

15. The system according to claim 1 wherein the temperature maintaining module is configured to removably receive the food storage receptacle to facilitate cooling of the food storage receptacle and food received therein.

16. The system according to claim 1 wherein the temperature maintaining module has a substantially planar thermally conducting base portion and the food storage receptacle has a substantially planar food receiving portion disposed proximate and parallel to the thermally conducting base portion, said planar food receiving portion being in thermal communication with said thermally conducting base portion.

17. The system according to claim 1 wherein the temperature maintaining module has a planar thermally conducting base portion and the food storage receptacle is substantially planar and is disposed proximate and parallel to the thermally conducting base portion, said planar food storage receptacle being in thermal communication with said thermally conducting base portion.

18. A modular refrigerated food container system for use in buffet bars, the system comprising:

a plurality of food storage receptacles for receiving food;

a plurality of receptacle temperature maintaining modules, each temperature maintaining module configured to receive the food storage receptacle and thermally communicate therewith to maintain a predetermined temperature of the food storage receptacle;

each said temperature maintaining module fluidly connected to each other by a substantially flexible fluid transporting tube;

at least one thermostat connected to at least one temperature maintaining module to regulate the temperature of the temperature maintaining module independent of the temperature of an adjacent temperature maintaining module;

each said temperature maintaining module including a thermally conducting inside wall, a substantially insulating outside wall, and a heat exchange device disposed therebetween; and a refrigeration device operatively coupled to the plurality of temperature maintaining modules to provide thermal exchange fluid to each temperature maintaining module.

19. The system according to claim 18 wherein the heat exchange device further includes a heat exchange tube configured to transport the thermal exchange fluid, said heat exchange tube having a plurality of heat sink fins attached thereto to increase the rate of heat exchange between the thermal exchange fluid, the heat exchange tube, and the thermally conducting inside wall, said heat sink fins disposed proximate the thermally conducting inside wall.

20. A modular heated food container system for use in buffet bars, the system comprising:

a plurality of food storage receptacles for receiving food;

a plurality of receptacle temperature maintaining modules, each temperature maintaining module configured to receive the food storage receptacle and thermally communicate therewith to maintain a predetermined temperature of the food storage receptacle;

each said temperature maintaining module fluidly connected to adjacent temperature maintaining modules by a substantially flexible fluid transporting tube; and a heating device operatively coupled to the plurality of temperature maintaining modules to provide thermal exchange fluid to each temperature maintaining module.

21. The system according to claim 20 wherein each temperature maintaining module includes a thermostat to regulate the temperature of the temperature maintaining module independent of the temperature of an adjacent temperature maintaining module.

22. The system according to claim 20 wherein each temperature maintaining module further includes a thermally conducting inside wall, a substantially insulating outside wall, and a heat exchange device disposed therebetween to heat the inside wall.

23. The system according to claim 20 wherein each temperature maintaining module further includes a thermally conducting inside wall, a substantially insulating outside wall, and a space between the inside wall and the outside wall to allow a thermal exchange fluid to pass through to provide heat exchange between the fluid and the inside wall.

24. The system according to claim 23 wherein each temperature maintaining module further includes baffles operatively fixed in the space between the outside wall and the inside wall to guide the thermal exchange fluid through the space so that the fluid comes into contact with the inside wall.

25. A modular temperature maintaining food container system for use in buffet bars, the system comprising:

a plurality of food storage receptacles for receiving food;

a plurality of receptacle temperature maintaining modules, each module comprising a thermally conducting inside wall, a substantially insulating outside wall, and a heat exchange device disposed therebetween to cool the inside wall and each module configured to receive the food storage receptacle and thermally communicate therewith to maintain a predetermined temperature of the food storage receptacle;

each said temperature maintaining module fluidly connected to adjacent temperature maintaining modules by a substantially flexible fluid transporting tube;

at least one thermostat connected to at least one temperature maintaining module to regulate the temperature of the temperature maintaining module independent of the temperature of an adjacent temperature maintaining module; and a heat pump operatively coupled to the plurality of temperature maintaining modules to provide thermal exchange fluid to each temperature maintaining module.

* * * * *

UNITED STATES PATENT AND TRADEMARK OFFICE

CERTIFICATE OF CORRECTION

PATENT NO. : 5,921,096
DATED : July 13, 1999
INVENTOR(S) : John S. Warren

It is certified that error appears in the above-identified patent and that said Letters Patent is hereby corrected as shown below:

In claim 1, in column 8, at line 66, please replace "maianining" with --maintaining--.

Signed and Sealed this

Seventh Day of December, 1999

*Attest:*

Q. TODD DICKINSON

*Attesting Officer*

*Acting Commissioner of Patents and Trademarks*